United States Patent [19]

Garlapaty et al.

[11] 4,373,427

[45] Feb. 15, 1983

[54] FLUID PRESSURE CYLINDER

[75] Inventors: Venkat R. Garlapaty, Plymouth; Michael J. Hall; William C. Branham, both of Wayzata, all of Minn.

[73] Assignee: Tol-O-Matic, Inc., Minneapolis, Minn.

[21] Appl. No.: 117,347

[22] Filed: Jan. 31, 1980

[51] Int. Cl.[3] ..... F01B 29/08

[52] U.S. Cl. ..... 92/88; 277/170

[58] Field of Search ..... 92/88, 169, 138, 178; 244/63; 277/80, 170, DIG. 7, 70, 2, 168

[56] References Cited

U.S. PATENT DOCUMENTS

| | | | |
|---|---|---|---|
| 2,373,455 | 4/1945 | Carey | 92/88 |
| 2,648,310 | 8/1953 | Baer, Sr. | 92/88 |
| 3,019,813 | 2/1962 | Dommann | 137/580 |
| 3,404,855 | 10/1968 | Scholl | 244/63 |
| 3,421,718 | 1/1969 | Gehringer | 92/88 |
| 3,504,872 | 4/1970 | Russell-French | 92/88 |
| 3,700,248 | 10/1972 | Teske | 277/80 |
| 3,708,177 | 1/1973 | Baermann | 277/80 |
| 3,820,446 | 6/1974 | Granbom | 92/88 |
| 3,893,378 | 7/1975 | Hewitt | 92/88 |
| 4,164,893 | 8/1979 | Granbom | 92/88 |

FOREIGN PATENT DOCUMENTS

| | | | |
|---|---|---|---|
| 470088 | 8/1937 | United Kingdom | 92/88 |

*Primary Examiner*—Abraham Hershkovitz
*Attorney, Agent, or Firm*—Dorsey & Whitney

[57] ABSTRACT

A fluid power cylinder having a cylinder with an elongated slot extending generally parallel to the longitudinal axis of the cylinder, a reciprocally movable piston and a strip sealing means for successively sealing the slot during movement of the piston. The sealing member is of a laminated construction and is constructed partially of a magnetized rubber-like material for magnetic attraction to the cylinder wall adjacent the slot. The sealing member also includes beveled edges for engagement with beveled edges adjacent the slot.

25 Claims, 12 Drawing Figures

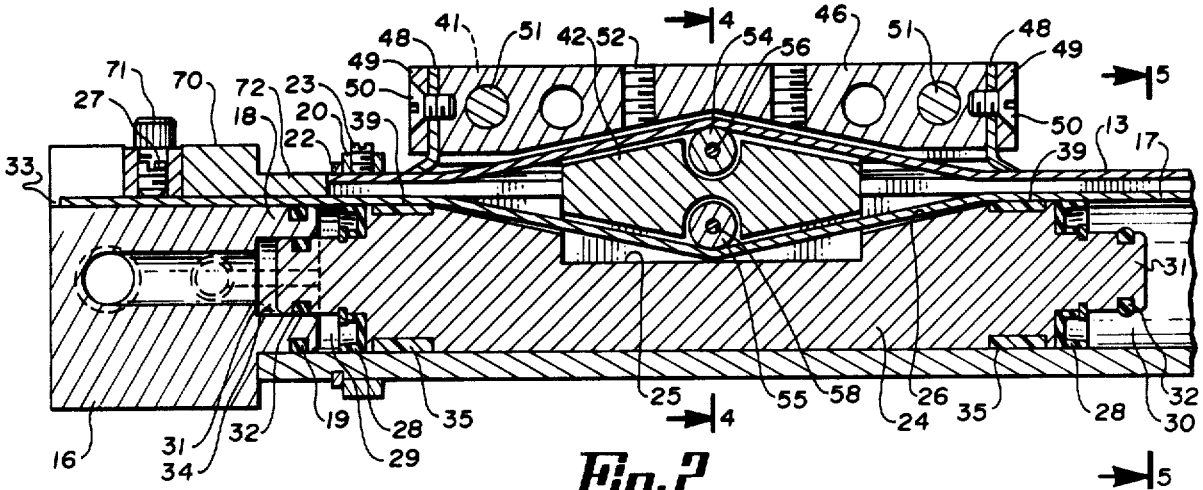
Fig. 2
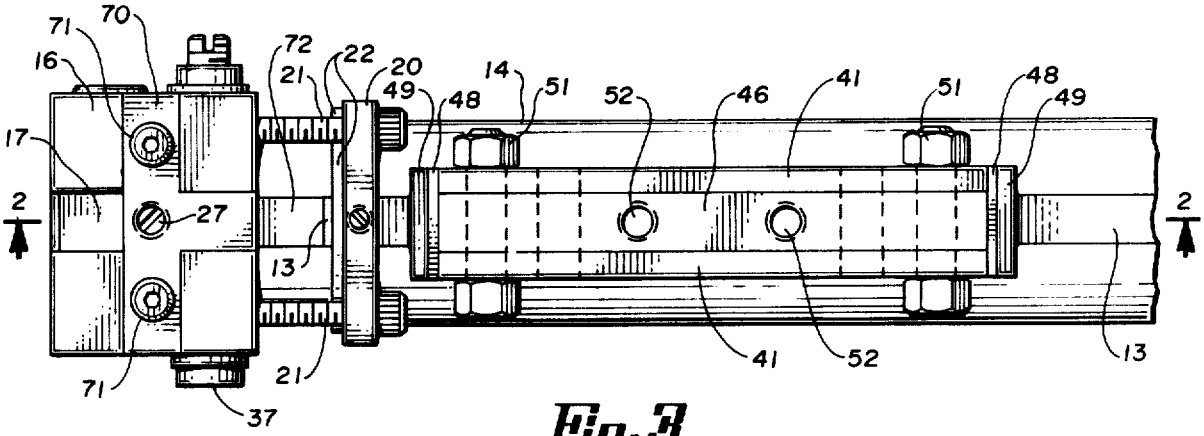
Fig. 3
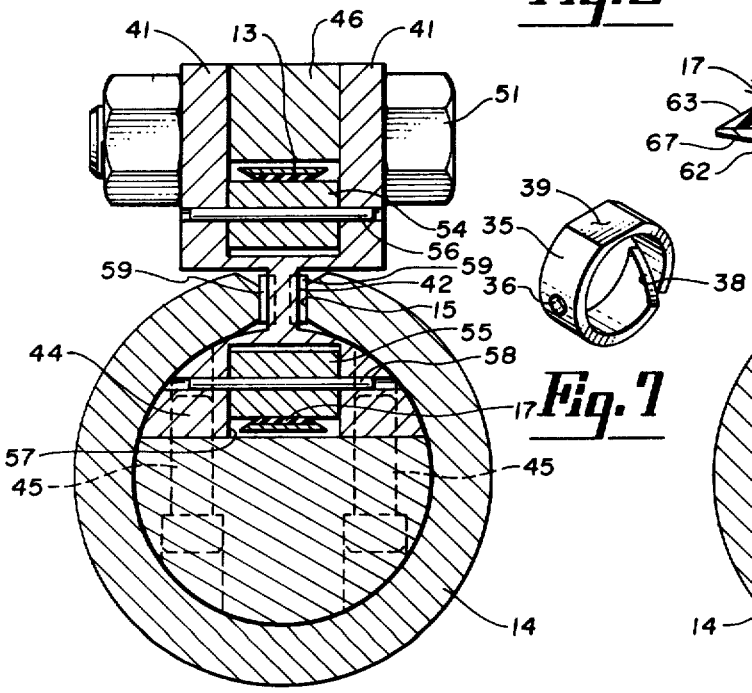
Fig. 4
Fig. 7
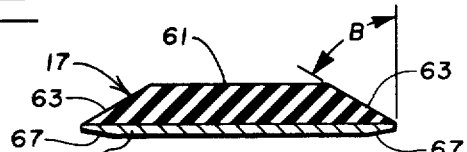
Fig. 6
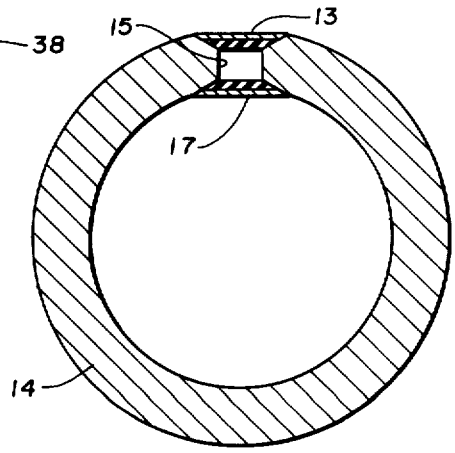
Fig. 5

FLUID PRESSURE CYLINDER

BACKGROUND OF THE INVENTION

The present invention relates generally to an improved fluid power cylinder, and more particularly, to a fluid power cylinder of the type having a cylinder with an elongated slot, a piston reciprocally movable within the cylinder and an improved strip sealing means for successively sealing the slot during movement of the piston.

Power cylinders, and in particular pressure fluid power cylinders, have existed in the art for many years. In general, a pressure fluid power cylinder includes an elongated cylinder and a piston member disposed therein for reciprocal back and forth movement along the length of the cylinder. Such movement is controlled by the introduction of hydraulic or pneumatic fluid pressure into the chambers at the ends of the cylinder on each side of the piston element. Such power cylinders also include means for transferring the reciprocal movement of the piston to an external workpiece. One type of power cylinder is a cable cylinder which includes a cable connected to opposite ends of the piston and extending around pulleys at the cylinder ends to transfer the force to the workpiece. A second type of fluid cylinder is the type illustrated in U.S. Pat. No. 3,820,446. In this type of cylinder, the bracket for transferring the force from the reciprocating piston to the workpiece is connected directly with the piston element. This connection is through an elongated slot disposed about the entire length of the cylinder element. Because of this elongated slot in the cylinder element, an elongated strip or band seal is needed to seal the pressure chambers in the opposite ends of the cylinder to prevent the pressure fluid from escaping through the slot.

While many of the prior art fluid power cylinders perform satisfactorily in certain applications, there continue to be ways in which such power cylinders can be improved. For example, with power cylinders of the type having a cylinder with an elongated slot, a reciprocally movable piston and a strip sealing member, efforts are continually being made to improve the sealing relationship between the strip seal and cylinder, to increase the life and wearability of the seal and cylinder and to develop cylinders of different sizes and for various applications. Thus, a need continues to exist in the art for a cylinder having the above mentioned improvements and flexibility.

SUMMARY OF THE INVENTION

The present invention relates generally to a fluid power cylinder of the type having an elongated cylinder with an elongated slot, a reciprocally movble piston, and a seal means for successively sealing the slot during movement of the piston. The structure of the present invention includes an improved strip seal member for significantly improving the sealing capabilities between such member and the cylinder wall. The present invention also includes means for significantly improving the life and wearability of the elongated strip sealing member, thus reducing the time needed to maintain the cylinder in working operation and the maintenance costs.

More particularly, the structure of the present invention includes an elongated cylinder element constructed of a material having magnetic properties, a piston member movable within such cylinder in back and forth reciprocal movement, and an elongated slot in the cylinder extending its entire length. The structure also includes a force transfer bracket connected directly to the piston and movable along the cylinder with a portion extending through the elongated slot. The slot includes beveled edges designed to mate with an elongated strip sealing member having similarly beveled edges. A roller bearing structure is associated with the piston and bracket assembly to guide the strip seal member through the piston and bracket. This improved bearing structure reduces the wear on the seal member and thus increases the seal life. The strip seal element comprises a laminated structure having a thin layer of metal with magnetic properties and a layer of magnetized rubber. The magnetic material in the rubber attracts to the wall of the cylinder to provide sealing engagement between these elements.

The preferred structure of the present invention also includes a second strip seal member associated with the elongated slot and an improved wear band or wear ring for still further increasing the life of the primary strip seal member and an improved piston seal for use in combination with the strip seal member.

Accordingly, it is an object of the present invention to provide a fluid power cylinder having an improved strip sealing means.

Another object of the present invention is to provide a fluid power cylinder having a strip sealing means with improved sealing characteristics.

A further object of the present invention is to provide a fluid power cylinder having a strip sealing member and means for significantly improving the life and wearability thereof.

Another object of the present invention includes roller bearing means for guiding the seal member away from the slot to enable movement of the piston along the cylinder.

A further object is to provide an improved piston seal for use in combination with the strip seal member.

Another object of the present invention is to provide a fluid power cylinder having a pair of strip seal members.

These and other objects of the present invention will become apparent with reference to the drawings, the description of the preferred embodiment and the appended claims.

DESCRIPTION OF THE DRAWINGS

FIG. 2 is a sectional view of the fluid power cylinder of the present invention as viewed along the section line 2—2 of FIG. 3.

FIG. 3 is a plan, top view of the fluid power cylinder of the present invention.

FIG. 4 is a sectional view as viewed along the section lines 4—4 of FIG. 2.

FIG. 5 is a sectional view as viewed along the section lines 5—5 of FIG. 2.

FIG. 6 is a sectional view of the strip sealing member showing the laminations of metal and magnetized rubber.

FIG. 7 is a pictorial view of the wear band as used in the present invention.

DESCRIPTION OF THE PREFERRED EMBODIMENT

Figures 1, 8:
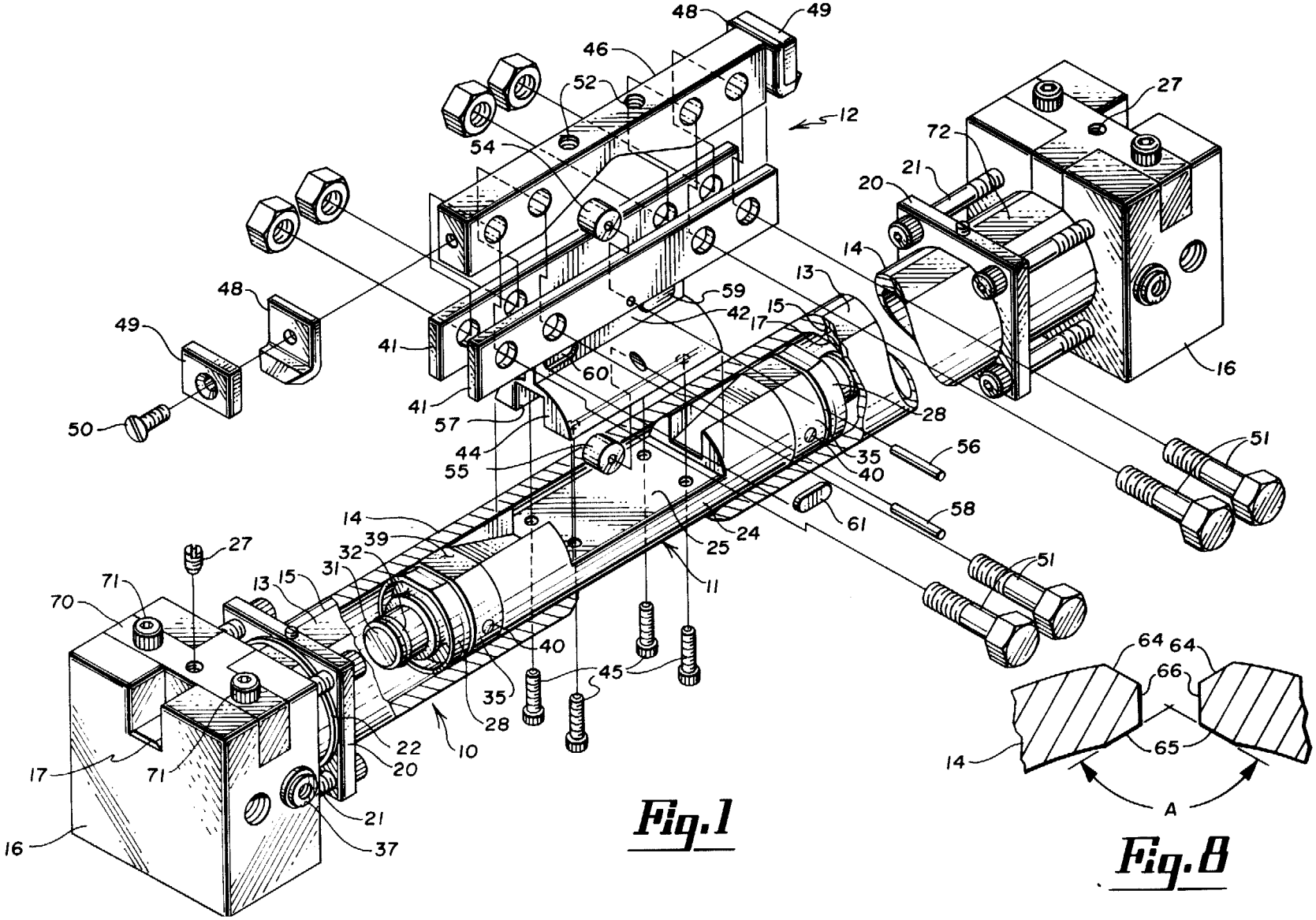
FIG. 1 is a pictorial, broken apart view of the fluid power cylinder of the present invention.
FIG. 8 is an enlarged view of a portion of the cylinder showing the slot configuration and the seat angles for the elongated strip seal.

Reference is first made to FIGS. 1, 2 and 3 showing various views of the fluid power cylinder of the present invention. In general, the power cylinder of the present invention includes an elongated fluid cylinder assembly 10 and a piston assembly 11 adapted for reciprocal back and forth movement within the cylinder assembly 10. A force transfer bracket assembly 12 is connected with the piston assembly 11 for movement therewith along an elongated slot 15 (FIGS. 4 and 5) formed in the cylinder 10.

More specifically, the cylinder assembly 10 includes an elongated cylindrically shaped cylinder element 14 having an elongated slot 15 (FIGS. 4 and 5) of predetermined width extending generally parallel to the longitudinal axis of the cylinder along its entire length. In the preferred embodiment, the cylinder element 14 is constructed of a material having magnetic properties such as steel; however, it is contemplated that such cylinder member can also be constructed of other types of materials and still incorporate many of the features of the present invention. The elongated cylinder member 14 has its ends appropriately connected to a pair of cylinder head assemblies 16 disposed at opposite ends of the member 14. As illustrated best in FIG. 2, the head assembly 16 includes an inwardly projecting portion 18 adapted to fit within an end of the cylinder 14. A square ring seal 19 is disposed in a ring groove between the portion 18 and the inner wall of the cylinder 14 to form a seal and prevent the escape of fluid pressure from within the cylinder 14. The cylinder 14 is secured to the head assembly 16 in a conventional manner by the clamp plate 20, the retaining ring 22 and the plurality of threaded members 21. In the preferred embodiment the retaining ring 22 seats within a groove in the outer surface of the cylinder member 14. The clamp plate 20 is then tightened against the retaining ring 22 by the members 21 which are threadedly received by the head assembly 16. The head 16 includes ports for the introduction of fluid pressure into and exhaustion of fluid pressure from the interior of the cylinder 14.

With reference to FIGS. 5 and 8, the elongated slot 15 includes a pair of opposing inner surfaces 66, 66 and two pairs of opposing beveled edges 64, 64 and 65, 65. The beveled edges 64, 64 join the slot with the outer surface of the cylinder 14 while the beveled edges 65, 65 join the slot with the inner surface of the cylinder 14. As will be discussed below, the beveled edges 64, 64 and 65, 65 are adapted for engagement with corresponding beveled edges of elongated outer and inner strip seal members 13 and 17, respectively, to seal the slot 15.

As best illustrated in FIG. 2, the exterior or outer elongated strip seal member 13 extends from one end of the cylinder 14, through the force transfer bracket assembly 12 and is then secured to the other end of the cylinder 14. The member 13 is retained in operative engagement with the cylinder 14 by a setscrew 23 positioned near each end of the cylinder 14. The setscrew 23 is threadedly received by the locking collar 20. As the member 23 is rotated into the lock collar 20, it engages the strip seal member 13 and retains the same in an operative position. The elongated interior or inner strip seal member 17 extends through a portion of the piston and force transfer assemblies 11 and 12 and are retained at each end of the cylinder by the setscrews 27. The setscrews 27 are threadedly received by a generally "T" shaped member 70 (FIGS. 1-3) disposed in a "T" shaped opening in the end housing 16. The member 70 is retained by a pair of threaded members 71.

The specific construction of both the inner and outer sealing elements 17 and 13 is illustrated best in FIG. 6. As shown, both of the elements 13 and 17 comprise a laminated structure having a layer of generally thin, non-elastic but flexible steel portion 62 laminated to a thicker section 61 constructed of a magnetic, rubber-like material. In the preferred embodiment, the layer 61 is a rubber-like material having particles embedded therein resulting in a rubber-like material having magnetic properties. Each of the side edges of the sealing members 13 and 17 includes a beveled edge 63 which is disposed at an angle "B" to appropriate engage the beveled edges 65, 65 and 64, 64 (FIG. 8) of the slot 15. The relationship between the sealing members 13 and 17 with respect to the slot 15 and its beveled edges is shown best in FIG. 5. As shown, beveled edges 67, 67 are also included on the opposite side of the members 17 and 13 to facilitate an improved sealing relationship between the piston seal and the back side of seal member 17 as will be described below.

In the preferred embodiment, the angle at which the edges of the sealing member 13 are beveled is approximately equal to the angle of the beveled edges 64, 64 (FIG. 8). Similarly, the angle at which the edges of the sealing member 17 are beveled is approximately equal to the angle of the beveled edges 65, 65. It has also been found, however, that if the bevel of the beveled edges 63 is slightly smaller, (i.e.) the angle "B" of FIG. 6 is slightly smaller, than the corresponding angle of the beveled edges 64, 64 and 65, 65 (FIG. 8), pressure on the inside of the cylinder 14 tends to assist the seal between the beveled edges of the strip 17 and the beveled edges 65, 65 of the cylinder 14. This slight difference in size preferably should be between one and two degrees. This permits face-to-face engagement between the beveled edges of the member 13 and the beveled edges 64, 64 and between the beveled edges of the member 17 and the beveled edges 65, 65 for successively sealing the slot 15 during movement of the piston assembly 11. While the included angle "A" between the beveled edges 65, 65 (FIG. 8) can vary, such angle "A" in the preferred embodiment is approximately 120°.

The piston assembly 11 is slidably movable within the cylinder member 14 and includes an elongated piston member 24 adapted for reciprocal movement along the interior of the cylinder 14 in response to the introduction of fluid pressure into the cylinder 14. The piston 24 includes a central area 25 for direct connection with the force transfer bracket assembly 12 and a pair of guide slots 26 for guiding the strip seal member through the bracket 12 as will be discussed below. Each end of the piston 24 includes a piston seal member 28 extending about the periphery of the piston 24 for forming a fluid seal between the outer surface of the piston 24 and the inner cylindrical surface of the cylinder 14. These seal members 28 in conjunction with the seal members 19 and the strip seal members 13 and 17 define a pair of fluid pressure chambers 29 and 30 within the cylinder member 14 at opposite ends of the piston 24.

Figure 9:
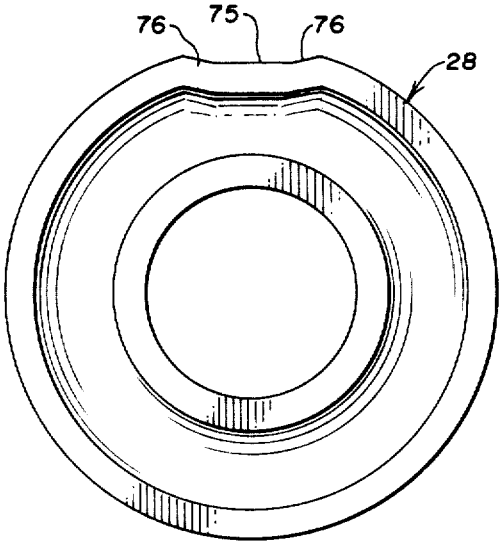
FIG. 9 is a plan view of the improved piston seal of the present invention.
Figure 10:
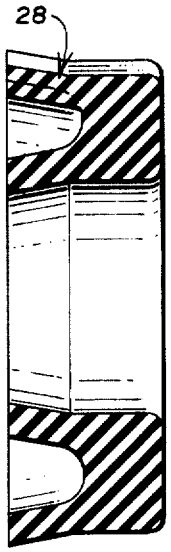
FIG. 10 is a sectional view of the seal of FIG. 9 as viewed along the section line 10—10 of FIG. 9.
Figure 11:
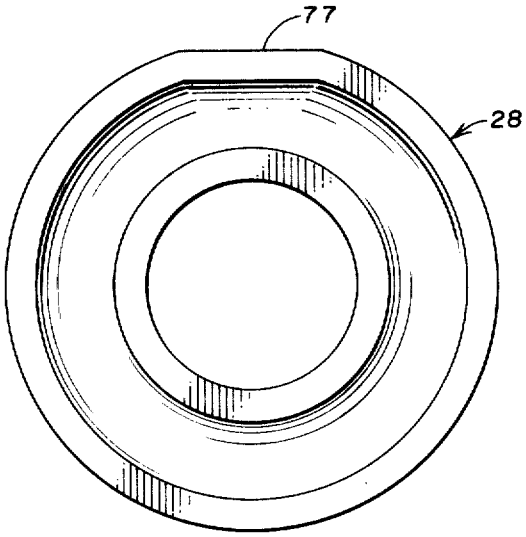
FIG. 11 is a plan view of an alternate embodiment of the improved piston seal.
Figure 12:
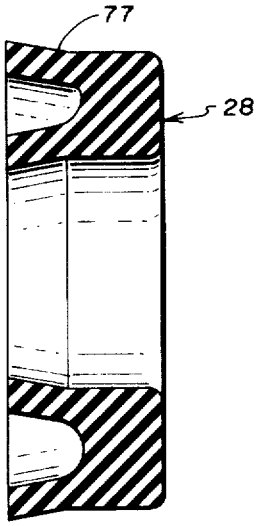
FIG. 12 is a sectional view of the seal of FIG. 11 as viewed along the section line 12—12 of FIG. 11.

The specific structure of the seal members 28 is illustrated in FIGS. 9-12. FIGS. 9 and 10 show a preferred embodiment of the piston seal 28 while FIGS. 11 and 12 show an alternate embodiment. The seal 28 of FIGS. 9 and 10 is a cup seal with a generally "U" shaped cross-section and a plurality of flat surfaces 75, 76 and 76 on one side to substantially conform to the inner side of the strip seal 17. The surface 75 is centrally positioned between the two side surfaces 76, 76.

In FIGS. 11 and 12, only a single flat surface 77 is disposed on the edge of the seal 28. It has been found that the provision of the flat surfaces 75, 76 and 76 in FIGS. 9 and 10 and the flat surface 77 in FIGS. 11 and 12 improves the sealing relationship between such seal and the inner surface of the strip seal 17.

The extreme outer ends of the piston 24 include a projecting portion 31 having an "O" ring 32 disposed about its periphery. This projecting portion 31 and associated "O" ring 32 function to cushion the stopping of the piston 24 as it reaches the end of a stroke. This is accomplished by movement of the portion 31 into a corresponding cylindrical opening 34 at the inner end of the head assembly 16. As the "O" ring 32 contacts the opening 34, fluid within the opening 34 is compressed to thereby cushion the piston 24.

A wear ring or wear band 35 is also disposed in an annular groove within the piston 24 near each of its ends. In the preferred embodiment, the bands 35 are located just inside each of the grooves for the piston seals 28. As illustrated generally in FIGS. 1 and 2 and more particularly in FIG. 7, each of the wear rings 35 comprises a generally annular shaped member having a hole 36 on one side, a diagonal shaped space or slot 38 on the side opposite the hole and a generally flat section 39 on top. As shown best in FIG. 1, the hole 36 engages with a corresponding projection 40 formed with the piston 24 to properly position and align the wear band 35 with respect to the piston 24. The diagonal slot which may also be generally parallel to the longitudinal axis of the band 35 permits the band to be spread apart for installation onto the piston 24 and permits easy removal when replacement or maintenance is needed or desired. The flat section 39 provides a bearing surface for the strip seal member 17 (FIGS. 1 and 2) as it changes direction during its passage through the piston assembly 11 and assists in correctly positioning the member 17. The band 35 also insures a good seal. In the preferred embodiment, the wear ring 35 is constructed of a nylon material; however, it is contemplated that any long wearing, low friction material could be used.

Reference is next made to FIGS. 1-4 illustrating the force transfer bracket assembly which is indicated by the general reference numeral 12. The bracket assembly 12 includes a pair of spaced apart, parallel connecting brackets 41, 41, a centrally disposed web section 42 and a base section 44. The base 44 is adapted for connection with the central portion 25 of the piston 24 by a plurality of threaded members 45. As illustrated best in FIGS. 1 and 4, the connecting brackets 41 are integrally joined with the base member 44 by the web section 42. In the preferred embodiment, the base section 44 is disposed within the cylinder member 14 while the pair of connecting brackets 41 are disposed outside the cylinder 14. The web section 42 connects the base 44 and bracket 41 and is disposed within the elongated slot 15. A pair of wear strip members or inserts 59 and 61 are disposed in recessed areas on opposite sides of the web portion 42 to assist in guiding the bracket 12 and to prevent rubbing contact between the web 42 and the surfaces of the slot 15. In the preferred embodiment, the members 59 and 61 are constructed of nylon or other low friction material.

A mounting plate or mounting bar 46 is secured between the connecting brackets 41 by a plurality of threaded members 51 extending through appropriately positioned holes in the brackets 41 and the bar 46. A wiper member 48 is secured to each end of the mounting bar 46 by an end cap 49 and an appropriate screw 50. The purpose of the wiper section 48 is to wipe dirt and other foreign particles from the top of the strip seal element 13 and to prevent dust and dirt from entering the interior portion of the transfer bracket assembly 12 and thus the interior of the cylinder 14. In the preferred embodiment, the wiper 48 is constructed of a nylon material although it is contemplated that various other types of materials could also be used. The wiper 48 also functions to urge the seal member 13 toward engagement with the cylinder 14 and to assist in alignment of the member 13. As shown, the mounting bar 46 includes a pair of threaded openings 52 at the top for appropriate connection with a work piece (not shown).

As illustrated best in FIGS. 2 and 4, guide means in the form of a pair of roller bearings 54 and 55, are provided within portions of the transfer bracket assembly 12 to guide the upper and lower strip seal members 13 and 17, respectively, through the piston and connector bracket assemblies 11 and 12. The rollers 54 and 55 guide the members 13 and 17 away from the slot 15 to permit movement of the piston and force transfer bracket assemblies 11 and 12 along the cylinder 14. The upper roller bearing 54 is rotatably supported on an appropriate axle 56 within the central portion of the mounting bracket assembly 12 and between the connecting bracket members 41. The lower roller bearing 55 is rotatably supported by an appropriate axle 58 in the base portion 44 between the inner surfaces of an alignment groove 59 (FIGS. 1 and 4) formed within the lower section of the base 44.

Having described the structure of the present invention, its operation can be understood as follows. First, in constructing the power cylinder of the present invention, the piston assembly 11, the cylinder assembly 10 and the force transfer bracket assembly 12 are assembled with the strip sealing members 13 and 17 extending through the piston and bracket assemblies 11 and 12 as illustrated in FIG. 2. The cylinder 14 is then connected with the end members 16 by tightening the threaded members 21. The strip sealing members 13 and 17 are then tightened and secured by the setscrews 23 and 27. Upon introduction of pressurized fluid into one end of the power cylinder, the piston assembly 12 is moved along the cylinder 14 in a direction opposite the chamber in which pressure is introduced. During this movement of the piston assembly 12, the flexible sealing elements 13 and 17 are guided away from the slot 15 and around the roller bearings 54 and 55 to permit movement of the web portion 42 along the slot. During operation, the inner strip seal member 17 is supported in part by the pair of wear rings 35 to reduce wear and thus increase the life of the sealing element 17. The outer seal member 13 is urged into engagement with the beveled surfaces of the slot 15 by the pair of wiper elements 48, 48. These elements 48, 48 urge movement of the member 13 into sealing engagement with the slot 15 as well as preventing dirt and other impurities from entering the interior of the cylinder 14. Both the seal members 13 and 17 are also urged into engagement with the corresponding beveled edges of the cylinder 14 as a result of the magnetic attraction between the magnetized sealing members 13 and 17 and the steel cylinder 14.

Although the description of the preferred embodiment has been quite specific, it is contemplated that various changes could be made without deviating from the spirit of the present invention. Accordingly, it is intended that the present invention be dictated by the appended claims rather than by the description of the preferred embodiment.

What is claimed is:

1. A fluid power cylinder comprising:

an elongated cylinder having a pair of pressure fluid chambers and an elongated slot of predetermined width extending generally parallel to the longitudinal axis of said cylinder, said cylinder further including a first pair of beveled cylinder edges joining the sides of said slot with the inner surface of said cylinder;

a piston reciprocally movable within said cylinder in response to the introduction of fluid pressure in said pressure fluid chambers; and an elongated inner strip seal member of greater width than said slot, said inner seal member including a laminated structure comprising a first layer of thin, non-elastic but flexible material and a second layer of magnetic material, said first and second layers being secured to one another, said inner seal member further having top and bottom generally flat surfaces parallel to one another and a first pair of beveled seal member edges for cooperating engagement with said first pair of beveled cylinder edges for successively sealing said slot during movement of said piston.

2. The fluid power cylinder of claim 1 wherein said cylinder is constructed of a material having magnetic properties whereby said inner elongated strip seal member is magnetically attracted toward said cylinder for engagement between said first pair of beveled cylinder edges and said first pair of beveled seal member edges.

3. The fluid power cylinder of claim 2 wherein said second layer is constructed of an elastic material having magnetic properties.

4. The fluid power cylinder of claim 3 wherein said second layer is constructed of a rubber-like material having magnetic particles embedded therein.

5. The fluid power cylinder of claim 1 wherein said cylinder includes a second pair of beveled cylinder edges joining the sides of said slot with the outer surface of said cylinder and wherein said fluid power cylinder includes an enlongated outer strip seal member of greater width than said slot, said outer seal member including a laminated structure comprising a first layer of thin, non-elastic but flexible material and a second layer of magnetic material, said outer seal member further having a pair of second beveled seal member edges for engagement with said second pair of beveled cylinder edges for successively sealing said slot during movement of said piston.

6. The fluid power cylinder of claim 5 wherein said cylinder is constructed of a material having magnetic properties whereby said inner and outer elongated strip seal members are magnetically attracted toward said cylinder for engagement between said first pair of beveled cylinder edges and said first pair of beveled seal member edges and between said second pair of beveled cylinder edges and said second pair of beveled seal member edges.

7. The fluid power cylinder of claim 6 wherein each of the second layers of said inner and outer seal members is constructed of a magnetic rubber-like material having magnetic properties.

8. The fluid power cylinder of claim 7 wherein each of said second layers of said inner and outer seal members is constructed of a rubber-like material having magnetic particles embedded therein.

9. The fluid power cylinder of claim 5 having a force transfer bracket connected with said piston for movement therewith, said bracket including a web section extending through said slot.

10. The fluid power cylinder of claim 9 including wiper means connected with said force transfer bracket for making wiping engagement with the outer surface of said outer seal member during movement of said force transfer bracket.

11. The fluid power cylinder of claim 9 including guide means for guiding said inner and outer seal members away from said slot to enable movement of said piston and connected force transfer bracket along the length of said cylinder.

12. The fluid power cylinder of claim 11 wherein said guide means includes a roller bearing associated with each of said inner and outer seal members.

13. The fluid power cylinder of claim 1 having a force transfer bracket connected with said piston for movement therewith, said bracket including a web section extending through said slot.

14. The fluid power cylinder of claim 13 including guide means for guiding said inner seal member away from said slot to enable movement of said piston and connected force transfer bracket along the length of said cylinder.

15. The fluid power cylinder of claim 14 wherein said guide means includes a roller bearing.

16. The fluid power cylinder of claim 14 including a wear band disposed about the periphery of said piston near each of its ends for engagement with said inner seal member.

17. The fluid power cylinder of claim 16 wherein each of said wear bands is constructed of a low friction material.

18. The fliud power cylinder of claim 17 wherein each of said wear bands is constructed of nylon.

19. The fluid power cylinder of claim 1 wherein said first pair of beveled seal member edges are formed, in part, along the edges of said second layer.

20. A fluid power cylinder comprising:

an elongated cylinder having a pair of pressure fluid chambers and an elongated slot of predetermined width extending generally parallel to the longitudinal axis of said cylinder, said cylinder being constructed of a material having magnetic properties and further including a first pair of beveled cylinder edges joining the sides of said slot with the inner surface of said cylinder;

a piston reciprocally movable within said cylinder in response to the introduction of fluid pressure in said pressure fluid chambers; and an elongated inner strip seal member of greater width than said slot, said inner seal member including a laminated structure comprising a first layer of thin, non-elastic but flexible material and a second layer constructed of a rubber-like material having magnetic properties, said inner seal member further having a first pair of beveled seal member edges for engagement with said first pair of beveled cylinder edges for successively sealing said slot during movement of said piston, whereby said inner elongated strip seal member is magnetically attracted toward said cylinder for engagement between said first pair of beveled cylinder edges and said first pair of beveled seal member edges, and wherein the respective angles of said first pair of beveled cylinder edges and said first pair of beveled seal member edges, relative to a common reference line, is substantially equal thereby enabling face-to-face engagement between said first pair of beveled cylinder edges and said first pair of beveled seal member edges.

21. The fluid power cylinder of claim 20 wherein the included angle between a projected extension of said first pair of beveled cylinder edges is approximately 120°.

22. A fluid power cylinder comprising:

an elongated cylinder having a pair of pressure fluid chambers and an elongated slot of predetermined width extending generally parallel to the longitudinal axis of said cylinder, said cylinder further including a first pair of beveled cylinder edges joining the sides of said slot with the inner surface of said cylinder and a second pair of beveled cylinder edges joining the sides of said slot with the outer surface of said cylinder;

a piston reciprocally movable within said cylinder in response to the introduction of fluid pressure in said pressure fluid chambers;

an elongated inner strip seal member of greater width than said slot, said inner seal member including a laminated structure comprising a first layer of thin, non-elastic but flexible material and a second layer constructed of a rubber-like material having magnetic properties, said inner seal member further having a first pair of beveled seal member edges for engagement with said first pair of beveled cylinder edges for successively sealing said slot during movement of said piston; and an elongated outer strip seal member of greater width than said slot, said outer seal member including a laminated structure comprising a first layer of thin, non-elastic but flexible material and a second layer constructed of a rubber-like material having magnetic properties, said outer seal member further having a pair of second beveled seal member edges for engagement with said second pair of beveled cylinder edges for successively sealing said slot during movement of said piston, wherein the respective angles of said first pair of beveled cylinder edges and said first pair of beveled seal member edges, relative to a common reference line, is substantially equal and the respective angles of said second pair of beveled cylinder edges and said second pair of beveled seal member edges, relative to a common reference line, is substantially equal, thereby enabling face-to-face engagement between said first pair of beveled cylinder edges and said first pair of beveled seal member edges and between said second pair of beveled cylinder edges and said second pair of seal member edges.

23. A fluid power cylinder comprising:

an elongated cylinder having a pair of pressure fluid chambers and an elongated slot of predetermined width extending generally parallel to the longitudinal axis of said cylinder said cylinder further including a first pair of beveled cylinder edges joining the sides of said slot with the inner surface of said cylinder;

a piston reciprocally movable within said cylinder in response to the introduction of fluid pressure in said pressure fluid chambers;

an elongated strip seal member of greater width than said slot for engagement with the inner surface of said cylinder along said slot to form a seal therebetween, said strip seal member including a laminated structure comprising a first layer of thin, non-elastic but flexible material and a second layer of magnetic material, said first and second layers being secured to one another, said strip seal member further having top and bottom generally flat surfaces parallel to one another and a first pair of beveled seal member edges for cooperating engagement with said first pair of beveled cylinder edges for successively sealing said slot during movement of said piston; and a piston seal member disposed about said piston for engagement with the inner surface of said cylinder and the inner surface of said strip seal member, said piston seal member having a flat outer surface section conforming generally to the configuration of an inner surface of said strip seal member.

24. A fluid power cylinder comprising:

an elongated cylinder having a pair of pressure fluid chambers and an elongated slot of predetermined width extending generally parallel to the longitudinal axis of said cylinder, said cylinder further including a first pair of beveled cylinder edges joining the sides of said slot with the inner surface of said cylinder;

a piston reciprocally movable within said cylinder in response to the introduction of fluid pressure in said pressure fluid chambers; and an elongated inner strip seal member of greater width than said slot, said inner seal member including a laminated structure comprising a first layer of thin, non-elastic but flexible material and a second layer constructed of a rubber-like material having magnetic properties, said first and second layers being secured to one another, said inner seal member further having a first pair of beveled seal member edges for cooperating engagement with said first pair of beveled cylinder edges for successively sealing said slot during movement of said piston.

25. The fluid power cylinder of claim 24 wherein said second layer is constructed of a rubber-like material having magnetic particles embedded therein.

* * * * *